US005154867A

United States Patent [19]

Edwards et al.

[11] Patent Number: 5,154,867

[45] Date of Patent: Oct. 13, 1992

[54] METHOD OF CONSTRUCTING AN ULTRA-HIGH MOLECULAR WEIGHT POLYETHYLENE SUCKER ROD GUIDE

[76] Inventors: Billy J. Edwards, 1917 Cambridge, Bossier City, La. 71112; Jimmy A. Starks, 1105 James, Bossier City, La. 71111

[21] Appl. No.: 622,509

[22] Filed: Dec. 5, 1990

Related U.S. Application Data

[60] Division of Ser. No. 502,793, Apr. 2, 1990, abandoned, which is a continuation-in-part of Ser. No. 357,794, May 30, 1989, Pat. No. 4,938,285, which is a continuation-in-part of Ser. No. 211,567, Jun. 27, 1988, Pat. No. 4,858,688.

[51] Int. Cl.[5] ..... B26D 3/00

[52] U.S. Cl. ..... 264/148; 83/39; 83/40; 83/54; 264/155

[58] Field of Search ..... 264/145, 146, 148, 150, 264/151, 154, 155; 83/39, 40, 54

[56] References Cited

U.S. PATENT DOCUMENTS

| | | | |
|---|---|---|---|
| Re. 31,016 | 8/1982 | Oster | 166/241 |
| 1,195,861 | 8/1916 | Smith | 264/155 |
| 2,299,978 | 10/1942 | Hall | 166/241 |
| 2,793,917 | 5/1957 | Ward | 166/241 |
| 3,661,480 | 5/1972 | Forschner et al. | 264/155 |
| 4,170,084 | 10/1979 | Fierheller | 264/148 |
| 4,171,560 | 10/1979 | Garrett | 264/262 |
| 4,433,964 | 2/1984 | Holtzberg et al. | 264/155 |
| 4,575,163 | 3/1986 | Sable | 166/241 |
| 4,858,688 | 8/1989 | Edwards et al. | 166/241 |
| 4,938,285 | 7/1990 | Edwards et al. | 166/241 |

*Primary Examiner*—Jay H. Woo
*Assistant Examiner*—James P. Mackey
*Attorney, Agent, or Firm*—John M. Harrison

[57] ABSTRACT

A method of manufacturing an ultra-high molecular weight polyethylene sucker rod guide, which includes the steps of providing a cylidnrical bar of ultra-high molecular weight polyethylene having a selected length, drilling a lonitudinal bore in the bar using a parabolic bit, tapering the ends of the bar and cutting a tapered slot in the bar for mounting the bar on a sucker rod.

4 Claims, 1 Drawing Sheet

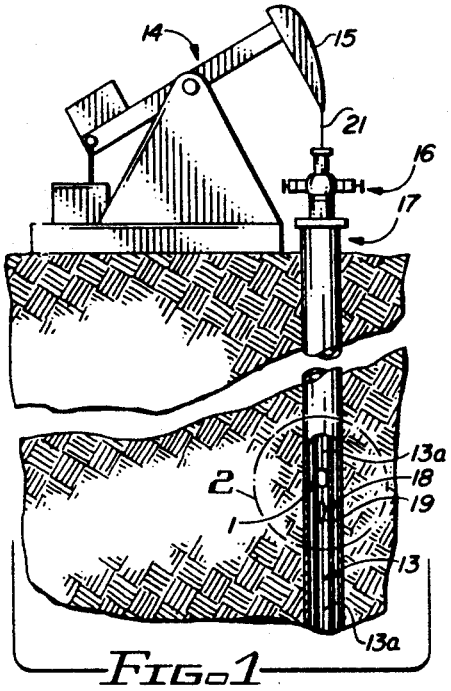
FIG. 1
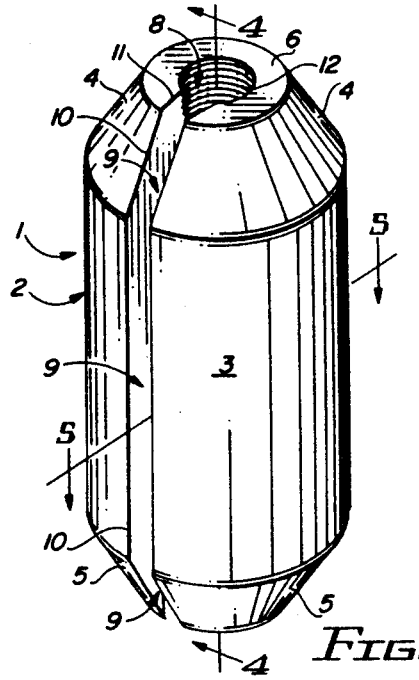
FIG. 3
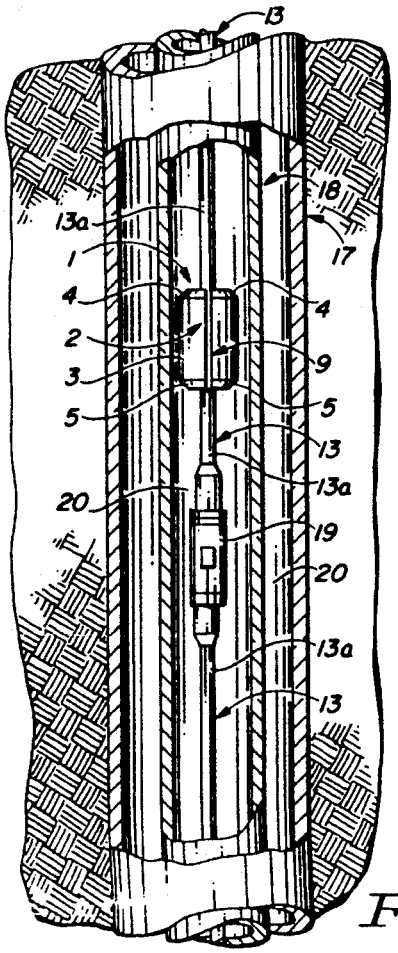
FIG. 2
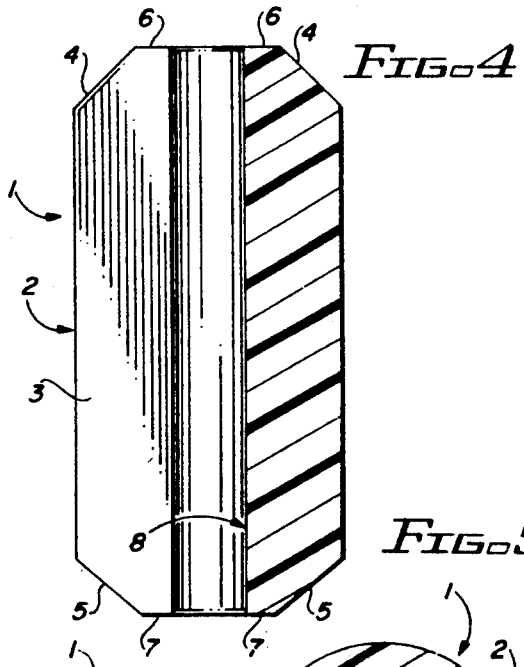
FIG. 4
FIG. 5
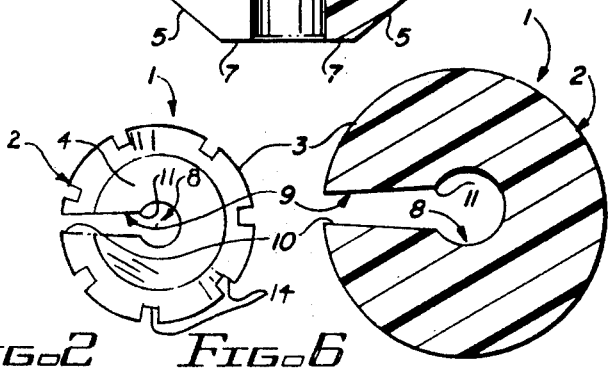
FIG. 6

METHOD OF CONSTRUCTING AN ULTRA-HIGH MOLECULAR WEIGHT POLYETHYLENE SUCKER ROD GUIDE

CROSS-REFERENCE TO RELATED APPLICATIONS

BACKGROUND OF THE INVENTION

This application is a divisional of U.S. patent application Ser. No. 07/502,793 filed Apr. 2, 1990, now abandoned, which is a continuation-in-part of U.S. Pat. application Ser. No. 07/357,794, filed May 30, 1989 now U.S. Pat. No. 4,938,285, which is a continuation-in-part of U.S. patent application Ser. No. 211,567, filed Jun. 27, 1988, now U.S. Pat. No. 4,858,688.

Field of the Invention

This invention relates to production equipment for oil wells and more particularly, to ultra-high molecular weight (UHMW) sucker rod guides for mounting in spaced relationship on the sucker rod string of a pumping well, and a method of constructing these sucker rod guides. The UHMW sucker rod guides of this invention may be color-coded for size identification and are each characterized by a generally cylindrically-shaped, smooth or longitudinally slotted guide body having tapered top and bottom portions and a longitudinal, grooved bore which is slightly undersized with respect to the sucker rod to which the sucker rod guides are attached. A tapered, inwardly expanding body slot extends longitudinally through the entire guide body of the sucker rod guide and communicates with the longitudinal bore, to provide a means for securely mounting one or more sucker rod guides on a sucker rod at a specific location or locations. In a preferred embodiment the sucker rod guide of this invention is constructed by extruding polyethylene plastic having desirable characteristics through a die to define a bar and cutting the bar into cylinders having an ultra-high molecular weight and a smooth, self-lubricating surface. The extruded cylinders are then centrally drilled with a parabolic bit to provide a longitudinal bore having spaced grooves. A tapered longitudinal slot is then cut in the cylinders for securely mounting the cylinders in spaced relationship on a sucker rod string.

It has surprisingly been found that extruded polyethylene having an ultra-high molecular weight and corresponding ultra-high density produces a self-lubricating sucker rod guide that yields highly favorable abrasion and friction-reducing qualities, as well as a high tensile strength and a relatively high coefficient of thermal expansion, along with other physical properties which are far superior to that of conventional sucker rod guides. In fact, it has been found by analysis and testing that extruded polyethylene plastic bar stock having a molecular weight above 600,000 accounts for the superior physical characteristics of the extruded polyethylene. It has also been found that the UHMW polyethylene sucker rod guides of this invention are not adversely affected by hydrogen sulfide, salt water and other corrosive fluids and materials normally found in an oil well.

Sucker rod guides of various description and composition are designed to fit on sucker rods used to pump oil wells, in order to greatly reduce many of the down-hole problems which are characteristic of production equipment in these oil wells. Because the UHMW polyethylene sucker rod guides of this invention are characterized by a wet or dry coefficient of friction which is lower than that of metal, they operate to significantly increase the overall pumping efficiency of the wells, while at the same time prevent undesirable metal-to-metal contact between the reciprocating or spinning sucker rods and the tubing. Wear on sucker rod couplings used to make up the down-hole sucker rod string is also minimized, thus reducing the required inventory of costly rod parts. Tubing wear, often unseen until failure occurs, is also reduced, because the sucker rod guides receive the wear rather than the expensive tubing. The sucker rod guides of this invention also function as bushings to centralize the sucker rods in the tubing and even when the tubing or sucker rod string buckles in a well during downstroke of the pumping unit, the sucker rods cannot contact the tubing due to the spaced positioning of the sucker rod guides on the sucker rods and the resulting lubricating effect. Polish rod loads are also reduced because of the lower friction and less abrupt "stress reverse" which is realized when using the highly efficient sucker rod guides detailed herein. Accordingly, a properly designed sucker rod installation using the UHMW polyethylene sucker rod guides of this invention can realize significant savings in both equipment replacement and service costs in a pumping oil well. Fewer "pulling jobs", greater pumping efficiency and wells that stay in the pumping mode for longer periods of time, are proven results obtained from the use of the specially designed UHMW sucker rod guides of this invention.

Sucker rod guides of various design, size and materials of construction are well known in the art. Among the typical materials of construction for these devices are neoprene rubber and nylon and these materials are commonly used with metal inserts which encase and line the sucker rod guide bore, to facilitate better gripping of the sucker rod by the sucker rod guide and maintaining the sucker rod guide in a selected position on the sucker rod. However, it has been found that friction generated between the neoprene rubber sucker rod guides and the tubing as the sucker rod guide reciprocates or spins with the sucker rod string inside the tubing, sometimes generates heat, which may result in a rapid deterioration of the neoprene material, thereby necessitating frequent and expensive "pulling jobs" in order to replace the guides. Furthermore, it has been found that nylon sucker rod guides are brittle and sometimes difficult to mount on a sucker rod without breaking, especially in cold weather.

Various sucker rod guides and related devices are well known in the art. An early "Casing Protector" is detailed in U.S. Pat. No. 2,299,978, dated Oct. 27, 1942, to J. E. Hall. The casing protector is fitted with grooved threads adapted for seating on a casing and protecting the casing. U.S. Pat. No. 2,793,917, dated May 28, 1957, to W. F. Ward, details "Sucker Rod Protectors" which are provided with slots for accessing a sucker rod and seating the sucker rod protectors on the sucker rod. A "Removable Drill Pipe Protector" is detailed in U.S. Pat. No. 2,897,016, dated Jul. 28, 1959, to R. C. Baker. The drill pipe protector is capable of being moved laterally of the drill pipe for mounting or demounting and serves to tenaciously grip the drill pipe and resist movement on the pipe under conditions encountered in the well bore. U.S. Pat. No. 3,320,004, dated May 16, 1967, to W. R. Garrett, details an "Earth Boring Apparatus" which utilizes an elastomeric sleeve disposed around a mandrel arranged for relative rotation, translation or both. A "Rod Guide" is detailed in U.S. Pat. No. 3,442,558, dated May 6, 1969, to D. E. Sable. The rod guide is provided with a spiral-shaped slot for accessing a sucker rod and mounting the rod guide on the sucker rod. A "Migratory Scraper and Valve" is detailed in U.S. Pat. No. 3,516,494, dated June 23, 1970, to W. F. Ward. The device serves as a paraffin scraper which is designed to migrate up and down the length of a sucker rod to clean the sucker rod, as well as the tubing in which the rod is reciprocating. A slot is provided longitudinally through one side of the scraper body for accessing the sucker rod and mounting the scraper on the sucker rod. A "Method for Making a Reinforced Plastic Apertured Tube" is detailed in U.S. Pat. No. 3,864,182, dated Feb. 4, 1975, to Samuel M. Shobert. The method includes the steps of providing an elongated strip of plastic material which will not bond to the plastic material from which the tube is formed, the strip having a base portion and an upstanding portion extending therefrom. The strip is wound on a mandrel with the base portion in engagement with the mandrel and the upstanding portion forming a generally helical groove, and circumferentially spaced, longitudinally-extending grooves are formed in the upstanding portion of the wound strip. A multi-filament glass strand is pre-wetted with a heat-hardenable plastic material and is wound in the helical groove and lengths of such strand are placed in the longitudinal grooves to substantially fill the helical and longitudinal grooves. The plastic material is then hardened to form a glass-reinforced plastic tube surrounding the base portion of the strip. U.S. Pat. No. 3,889,579, dated June 17, 1975, to J. W. Wiechowski, details an "Oil Well Pumping System Having Reinforced Plastic Sucker Rod". The patent details a system for pumping oil and a method for constructing a system in which a pump, disposed at the bottom of the well, is connected to the pump drive at the top of the well by a single length of reinforced plastic sucker rod having specific construction characteristics. U.S. Pat. No. 4,575,163, dated Mar. 11, 1986, to Donald E. Sable, details a "Rod Guide" employed to actuate a pump connected in the tubing of a well. The body of the rod guide is formed by a resilient substance adapted to resiliently grip the rod, the body having cam surfaces engagable with the rod to facilitate mounting of the guide on the rod. Arcuate internal stop surfaces are also provided at opposite ends of the body, the stop surfaces having substantially the same configuration as the surfaces of the enlargements or upsets at the other ends of the rod. The guide may engage if displaced on the rod, as by contact with an internal obstruction in the tubing. An "Anti-Friction Sucker Rod Guide Assembly" is detailed in Re 31,016, dated Aug. 24, 1982, to Clarence Oster. The anti-friction sucker rod coupling and guide apparatus includes a rod member having an anti-friction surface along its cylindrical length, fasteners attached to each end of the rod member for attaching the rod member within a sucker rod string and a rod guide having an inner anti-friction surface contacting the anti-friction surface of the rod member and slidably positioned on the rod member.

Sucker rod guides are typically secured to the respective lengths of sucker rod in spaced relationship, in order to space the sucker rod string from the tubing and protect both the sucker rod, sucker rod couplings and the tubing from excessive wear during the pumping operation. Since the reciprocating travel of each reciprocating sucker rod and sucker rod guide may range from approximately 3 feet to about 20 feet or more and this travel occurs at a rate of from about 5 to about 15 strokes per minute on the average, the material used in the sucker rod guide should be self-lubricating or easily lubricated by the well fluid and must have superior wear characteristics, in order to minimize frequency of maintenance. Each sucker rod guide should also remain in the installed position on the sucker rod, since the spacing of the sucker rod guides prevents the sucker rod from contacting and damaging the tubing.

Polyethylene based plastic mill shapes are most commonly available in low density, high density and the ultra high molecular weight (UHMW) formulations. Although the material has a common name (polyethylene), the properties of each product are unique and their applications in most cases are not interchangeable. If the material is purchased in a natural color, both color and texture are so similar that visual identification is impossible. UHMW polyethylene is the only grade of polyethylene used for such heavy duty applications as drag conveyors, bushing and bearing service. Since the UHMW materials natural appearance is the same as high density polyethylene, users have demanded that the material be colored for identification. Cost differences and service life are major reasons for the special colorization and although other polyethylene grades can be colored, the manufacturers are not offering such products except in very large quantities by special order. The only reason to match the characteristic UHMW polyethylene color with a lower grade product would be to substitute the material and supply an inferior product.

Accordingly, it is an object of this invention to provide a new and improved polyethylene sucker rod guide having an ultra-high molecular weight, for mounting on reciprocating or spinning sucker rods of oil wells and minimizing metal-to-metal contact between the sucker rod and the tubing.

Another object of this invention is to provide a new and improved, injection-molded or compression molded, ultra-high density polyethylene sucker rod guide which is characterized by a smooth or longitudinally slotted exterior surface, an exceptionally high abrasion resistance and good self-lubricating characteristics and is designed to tightly seat on a sucker rod of a pumping well at a specific location, with little or no displacement from the point of installation, to space the sucker rod from the well tubing.

Still another object of the invention is to provide a sucker rod guide which is constructed of extruded polyethylene having an ultra-high molecular weight (UHMW) of at least 600,000 for mounting on the sucker rod of a pumping unit in an oil well, which sucker rod guide includes a generally cylindrically-shaped, smooth or grooved or longitudinally slotted exterior body having a longitudinal, smooth or grooved sucker rod bore that is slightly undersized with respect to the sucker rod to which it is attached and further including an inwardly-expanding, tapered body slot extending longitudinally through the sucker rod guide body and communicating with the sucker rod bore, to facilitate mounting the sucker rod guide on the sucker rod.

Yet another object of the invention is to provide a color-coded, extruded, ultra-high density polyethylene sucker rod guide having an ultra-high molecular weight in the range of from about 600,000 to at least about six million and characterized by superior resistance to impact, wear, cracking, abrasion and corrosion, a high tensile strength, a relatively high coefficient of thermal expansion and a low coefficient of friction.

A still further object of this invention is to provide a generally cylindrically-shaped, color-coded, extruded, ultra-high molecular weight and ultra-high density polyethylene sucker rod guide provided with a longitudinal, circumferentially grooved sucker rod bore which is slightly undersized with respect to the sucker rod to which the guide is attached and a longitudinal, tapered slot extending through the sucker rod guide body and communicating with the sucker rod bore for mounting the sucker rod guide on the sucker rod.

Another object of the invention is to provide a method of manufacturing an ultra-high molecular weight polyethylene sucker rod guide, which method includes the steps of providing a cylindrical bar of ultra-high density and ultra-high molecular weight polyethylene having a selected length, drilling a longitudinal bore in the bar using a parabolic bit or other boring tool and cutting a tapered slot in the bar for mounting the bar on a sucker rod.

Yet another object of the invention is to provide a method of manufacturing an ultra-high molecular weight polyethylene sucker rod guide, which method includes the steps of providing a cylindrical bar of ultra-high density and ultra-high molecular weight polyethylene having a selected length, drilling a longitudinal bore in the bar using a parabolic bit or other boring tool and cutting multiple longitudinal production fluid slots or grooves in the outer surface and a tapered slot in the bar for mounting the bar on a sucker rod.

SUMMARY OF THE INVENTION

These and other objects of the invention are provided in a new and improved, color-coded sucker rod guide for mounting on a sucker rod in a reciprocating or spinning sucker rod oil well pumping unit, which sucker rod guide is characterized by an extruded, substantially self-lubricating, smooth, slotted or grooved ultra-high molecular weight polyethylene guide body. The guide body includes a top and bottom taper and a drilled, circumferentially grooved sucker rod bore extending longitudinally therethrough, which bore is slightly undersized with respect to the sucker rod to which it is attached. Further included is an inwardly-expanding, tapered slot extending longitudinally through the sucker rod guide body and communicating with the bore, for mounting the sucker rod guide on the sucker rod and insuring that the sucker rod guide is maintained approximately at the point of installation on the sucker rod during operation of the pumping unit. In a preferred embodiment, the degree of undersize of the sucker rod bore and the degree of taper provided in the tapered slot are chosen such that the slot walls are approximately parallel to each other when the sucker rod guide is mounted on a sucker rod. Also provided is a method of manufacturing an ultra-high molecular weight polyethylene sucker rod guide, which includes the steps of providing a cylindrical bar of ultra-high density and ultra-high molecular weight polyethylene having a selected length, drilling a longitudinal bore in the bar using a parabolic bit or other boring tool or instrument, tapering the ends of the bar and cutting a tapered slot in the bar for mounting the bar on a sucker rod.

BRIEF DESCRIPTION OF THE DRAWING

The invention will be better understood by reference to the accompanying drawing, wherein:

FIG. 1 is a side elevation, partially in section, of a typical reciprocating pumping unit and related production equipment for an oil well;

FIG. 2 is an enlarged sectional view of a length of casing and tubing illustrated in FIG. 1, with a sucker rod reciprocating inside the tubing and a sucker rod guide mounted on the sucker rod;

FIG. 3 is a perspective view of a preferred embodiment of an unmounted sucker rod guide of this invention;

FIG. 4 is a longitudinal sectional view taken along line 4—4 of the sucker rod guide illustrated in FIG. 3;

FIG. 5 is a traverse sectional view taken along line 5—5 of the sucker rod guide illustrated in FIG. 3; and FIG. 6 is a top view of an alternative preferred embodiment of the sucker rod guide, more particularly illustrating spaced longitudinal production fluid slots provided in the outer perimeter of the guide body.

DESCRIPTION OF THE PREFERRED EMBODIMENTS

Referring initially to FIGS. 1–3 of the drawing, a conventional pumping unit is generally illustrated by reference numeral 14 and is fitted with a horsehead 15 for reciprocating a polish rod 21 in a well head 16 and a connecting sucker rod string 13 inside a length of tubing 18, which is concentrically enclosed in a casing 17. The horsehead 15 is located above the well head 16 and the sucker rod string 13 extends downwardly from the polish rod 21 through the tubing 18 to a down-hole pump (not illustrated). The down-hole pump is designed to pump production fluid upwardly through a production annulus 20 located inside the tubing 18, as illustrated in FIG. 2. The sucker rod string 13 includes multiple lengths of elongated sucker rods **13*a*, which are joined at the sucker rod couplings 19**, in order to locate the down-hole pump (not illustrated) at a selected producing interval location (not illustrated) in the well.

Multiple units of the sucker rod guide 1 of this invention are located in spaced relationship on each of the sucker rods **13*a*, preferably at points near the sucker rod couplings 19, in order to radially space the sucker rods 13*a* and sucker rod couplings 19 from the inside wall of the tubing 18 during reciprocation of the sucker rod string 13 pursuant to operation of the pumping unit 14. As illustrated in FIG. 3 each sucker rod guide 1 is characterized by an extruded polyethylene guide body 2 having an ultra-high molecular weight and constructed to define a generally cylindrically-shaped, smooth center body section 3, which is terminated at one end by a top taper 4 and a flat top margin 6 and at the opposite end by a bottom taper 5 and a corresponding flat bottom margin 7. A sucker rod bore 8 is drilled or bored longitudinally through the center of the guide body 2 and in a preferred embodiment of the invention the diameter of the sucker rod bore 8 is slightly undersized and most preferably, about 1/16 of an inch undersized, with respect to the diameter of the sucker rod 13*a* to which the sucker rod guide 1 is attached. The sucker rod bore 8 may be smooth, as illustrated in FIG. 4. However, in another preferred embodiment of the invention, multiple circumferential grooves 12 are provided in the sucker rod bore 8 by operation of a parabolic bit or other drilling or boring tool (not illustrated), to help maintain each sucker rod guide 1 tightly on a companion sucker rod 13*a* in a selected location, as illustrated in FIG. 3. This contact is maintained in spite of contact between the guide body 2 and the inside surface of the tubing 18 during reciprocation or spinning of the sucker rod string 13. An inwardly-expanding, tapered body slot 9 is provided in the guide body 2 of the sucker rod guide 1 and the body slot 9 extends longitudinally from the top margin 6, completely through the guide body 2 and through the bottom taper 5 and bottom margin 7 and communicates with the sucker rod bore 8, as illustrated in FIGS. 3–5**.

As illustrated in FIGS. 3 and 5, in a most preferred embodiment of the invention, when the sucker rod guide 1 is not installed on a sucker rod 13*a*, the body slot 9 is tapered in expanding relationship from a narrow slot mouth 10 to a wider slot throat 11, such that the body slot 9 is wider at the slot throat 11 than at the slot mouth 10. Accordingly, this feature, in combination with the undersizing of the sucker rod bore 8 with respect to the sucker rod 13*a* to which the sucker rod guide 1 is attached, serves to effect a spring-like action in the sucker rod guide 1, to more tightly mount each sucker rod guide 1 on the companion sucker rod 13*a*. When the sucker rod guide 1 is installed on a sucker rod 13*a*, the slot mouth 10 is expanded and the spaced sides of the body slot 9 are approximately parallel, since the slot mouth 10 is then substantially equal to or greater than the width of the slot throat 11. It has been found that this configuration of the body slot 9, in combination with the undersizing of the sucker rod bore 8 and the circumferential grooves 12 serves to help maintain each sucker rod guide 1 substantially in the desired installed location on a companion sucker rod 13*a*, despite the reciprocating or spinning action of the sucker rod string 13 with accompanying frequent contact between the center body section 3 of the sucker rod guide 1 and the inside surface of the tubing 18.

Referring now to FIG. 6, the guide body 2 is provided with longitudinal, spaced production slots 14, which operate to facilitate free passage of production fluid through the tubing 18. The slots 14 also help to clear paraffin from the inside surfaces of the tubing 18 as the sucker rod string 13 and sucker rod guides 1 reciprocate or spin inside the tubing 18. While the slots 14 are characterized by channel-shaped openings it is understood that the slots 14 may be shaped as grooves or other geometrical patterns in the guide body 2, to any desired depth, as desired.

In a most preferred embodiment of the invention the sucker rod guide 1 of this invention is characterized by a cylindrical segment of an extruded polyethylene bar stock which has an ultra-high molecular weight with accompanying ultra-high density and excellent self-lubricating and/or wet-lubricating characteristics. For example, it has been found that these excellent lubricating qualities, as well as other superior physical properties, such as high tensile strength, high coefficient of thermal expansion, low coefficient of friction and excellent resistance to impact, stress cracking, corrosion and abrasion of the round extruded polyethylene bar stock used to fabricate the sucker rod guide 1, result from an ultra-high molecular weight of at least about 600,000, which ultra-high molecular weight results in an ultra-high density and accompanying physical properties that are far superior to that of conventional sucker rod guides.

The following Table I tabulates various physical properties of the ultra-high molecular weight and ultra-high density polyethylene sucker rod guide of this invention:

TABLE I

| Property | Test Method | Unit | Typ. Val. |
|---|---|---|---|
| Specific Gravity | ASTM D-792 | $g/cm^3$ | 0.94 |
| Yield Strength @ 73 F. | ASTM D-638 | p.s.i. | 3400 |
| Ultimate Tensile Strength @ 73 F. | ASTM D-638 | p.s.i. | 6800 |
| Break Elongation @ 73 F. | ASTM D-638 | % | 450 |
| Yield Strength @ 250 F. | Stress Strain Diag. | p.s.i. | 700 |
| Ultimate Tensile Strength @ 250 F. | Stress Strain Diag. | p.s.i. | 3300 |
| Break Elong. @ 250 F. | Stress Strain Diag. | % | 900 |
| Hardness- | | | |
| Rockwell "R" Scale | ASTM D-785 | — | 64 |
| Shore "D" | ASTM D-2240 | — | 67 |
| Flexural Modulus of Elasticity | Bnd/Crp/1 Min. Val. | p.s.i. | 110,000 |
| Shear Strength | ASTM D-732 | p.s.i. | 3500 |
| Izod impact + @ 23 C. | ASTM D-256A | ftlbs/in.ntch | No Break |
| − @ 140 C. | ASTM D-256A | ftlbs/in.ntch | No Break |
| Environmental Stress Cracking @ F. 50 | ASTM D-1693 MOD | hrs. | 6600 |
| Water Absorption | ASTM D-570 | — | NIL |

Referring again to FIGS. 3–5 of the drawing, it will be appreciated by those skilled in the art that in a most preferred embodiment of the invention, a length of UHMW polyethylene bar stock is cut to define cylinders of appropriate length and the centrally-located sucker rod bore 8 provided in the guide body 2 of the sucker rod guide 1, is then drilled in each cylinder with a parabolic bit or alternative drilling or boring apparatus, which inscribes the repetitive circumferential grooves 12 in the guide body 2. Furthermore, while the tapered body slot 9 can be extruded with the round bar stock, the tapered body slot 9 is preferably cut with a cutting tool such as a saw to the desired tapered specification. This cut is most preferably effected after placing a half-round bar in the sucker rod bore 8 with the flat portion of the bar facing the saw, and cutting parallel slots through each bar to the sucker rod bore 8. When the half-round bar is removed, the slot mouth 10 collapses slightly to define the desired taper in the body slot 9. Alternatively, the sucker rod bore 8 may be extruded in the round bar stock, along with the tapered body slot 9 and a special tool can then be used to ream and inscribe the circumferential grooves 12, as desired. It will be further appreciated that the top taper 4 and the bottom taper 5 are shaped in the guide body 2 when the individual sucker rod guides 1 are cut from the extruded bar stock, to insure that minimal friction is created in the bore of the tubing 18 when the sucker rod guide reciprocates or spins therein responsive to reciprocating or spinning movement of the sucker rod string 13.

Referring again to FIGS. 3 and 5 of the drawing, in another most preferred embodiment of the invention the sucker rod guide 1 is mounted on a sucker rod 13*a* by initially placing the guide body 2 on the sucker rod 13*a* with the slot mouth 10 lying adjacent to the sucker rod 13*a*. The guide body 2 is then struck sharply with a hammer or mallet to momentarily spring the tapered body slot 9 open and force the guide body 2 onto the sucker rod 13*a*, such that the sucker rod 13*a* locates and seats in the slightly undersized sucker rod bore 8. Accordingly, as heretofore described, the "spring" action created by the tapered body slot 9, coupled with the 1/16 inch undersize in the sucker rod bore 8, as well as the circumferential grooves 12, cause the guide body 2 to tightly grip the sucker rod 13*a* at the desired installed location and minimize movement of the sucker rod guide 1 on the sucker rod 13*a* responsive to reciprocation or spinning of the sucker rod string 13 and the sucker rod guide 1 inside the tubing 18. This "spring" action causes the slot mouth 10 of the body slot 9 to enlarge slightly when the sucker rod 13*a* is seated in the rod bore 8, such that the slot mouth 10 is substantially equal in width to that of the slot throat 11 after the seating procedure, as heretofore described.

It will be appreciated by those skilled in the art that the sucker rod guide of this invention can be color-coded and constructed to fit on sucker rods 13*a* of any diameter and specification, in non-exclusive particular, as follows: for a one inch O.D. sucker rod 13*a*, the slot mouth 10 of the body slot 9 is 9/16 of an inch, the slot throat 11 is 11/16 of an inch and the diameter of the sucker rod bore 8 is 15/16 of an inch. Similarly, for a sucker rod 13*a* having a diameter of 7/8 of an inch, the slot mouth 10 is 7/16 of an inch, the slot throat 11 is 9/16 of an inch and the diameter of the sucker rod bore 8 is 13/16 of an inch. Under circumstances where the sucker rod 13*a* is ¾ of an inch in outside diameter, the slot mouth 10 is 5/16 of an inch, the slot throat 11 is 7/16 of an inch and the diameter of the sucker rod bore 8 is 11/16 of an inch. Furthermore, for a sucker rod 13*a* which is 5/8 of an inch in outside diameter, the slot mouth 10 of the body slot 9 is 3/16 of an inch, the slot throat 11 is 5/16 of an inch and the diameter of the sucker rod bore 8 is 9/16 of an inch.

The following Table II tabulates various typical sizes and shades of color of the sucker rod guides as a function of sucker rod and tubing size:

TABLE II

| U.H.M.W. Rod Guide Size | Tubing OD | U.H.M.W. Rod Guide OD Installed, in Inches | Rod Size | U.H.M.W. Rod Guide Color Code |
|---|---|---|---|---|
| 2" × ⅝" | 2 1/16" or 2⅜" | 1.625" | ⅝" | White |
| 2" × ⅝" | 2⅜" | 1.875" | ⅝" | Orange |
| 2" × ¾" | 2⅜" | 1.875" | ¾" | Orange |
| 2" × ⅞" | 2⅜" | 1.875" | ⅞" | Orange |
| 2½" × ⅝" | 2⅞" | 2.125" | ⅝" | Green |
| 2½" × ¾" | 2⅞" | 2.125" | ¾" | Green |
| 2½" × ⅞" | 2⅞" | 2.125" | ⅞" | Green |
| 2½" × ¾" | 2⅞" | 2.375" | ¾" | Yellow |
| 2½" × ⅞" | 2⅞" | 2.375" | ⅞" | Yellow |
| 2½" × 1" | 2⅞" | 2.375" | 1" | Yellow |
| 3" × ¾" | 3½" | 2.625" | ¾" | Blue |
| 3" × ⅞" | 3½" | 2.625" | ⅞" | Blue |
| 3" × 1" | 3½" | 2.625" | 1" | Blue |

The sucker rod guide and process of manufacture of this invention is characterized by a high degree of utility, reliability and longevity, in that in a most preferred embodiment it is constructed of polyethylene having an ultra-high molecular weight of at least 600,000 and more preferably, in the range of from about 600,000 to about six million, which results in an ultra-high density and good self-lubricating and wet-lubricating characteristics, high abrasion resistance and toughness and the necessary resiliency to facilitate mounting on a sucker rod without shattering, deforming or moving excessively on the sucker rod. Most preferably, the ultra-high molecular weight of the polyethylene is in the range of from about 2 million to about 5 million and the polyethylene is extruded into bar stock for ease of manufacture. Furthermore, the sucker rod guide of this invention can be constructed to any desired specifications for fitting on a sucker rod of any selected outside diameter and is quickly and easily installed on the sucker rod according to the technique outlined above, using conventional tools and equipment. Moreover, while the sucker rod guide is most preferably constructed of extruded bar stock having the requisite ultra-high molecular weight, it will be appreciated that other molding techniques, including compression-molding and injection-molding procedures, in non-exclusive particular, which produce a polyethylene ultra-high density product of desired specifications, can also be used. Furthermore, techniques for injection-molding or compression-molding the ultra-high density sucker rod guide detailed herein directly on the sucker rod itself, can also be used without departing from the spirit and scope of the invention.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A method of constructing a plastic sucker rod guide for operating inside oil well tubing, comprising the steps of providing extruded polyethylene bar stock having an ultra-high molecular weight, cutting said bar stock into guide bars of selected length; drilling or boring a longitudinal bore through said guide bar to define a longitudinal wall; and cutting a slot longitudinally through the wall of said guide bars, said slot extending into said bore, for mounting said guide bars on a sucker rod.

2. The method according to claim 1 further comprising the step of cutting circumferential grooves in said bore.

3. A method of constructing an ultra-high molecular weight polyethylene sucker rod guide for mounting on a sucker rod operating inside oil well tubing comprising the steps of providing a cylindrically-shaped guide bar of selected ultra-high molecular weight, length and diameter; cutting a longitudinal bore through said guide bar to define a longitudinal wall and to create circumferential grooves in said bore; inserting a half-round bar in said bore and cutting a longitudinal slot through the wall of said guide bar with said half-round bar in place, whereby said slot extends to said bore and narrows at the periphery of said guide bar when said half-round bar is removed from said bore for mounting said guide bar on a sucker rod.

4. The method according to claim 3 further comprising the step of color-coding said guide bar according to the size of the tubing.

* * * * *